US005718474A

United States Patent [19]

Kojima et al.

[11] Patent Number: 5,718,474

[45] Date of Patent: Feb. 17, 1998

[54] FOLDABLE CHAIR

[75] Inventors: Kiyoshi Kojima; Takao Sugano, both of Osaka; Nobuyuki Nagai, Nara; Sakuji Ito, Nagano, all of Japan

[73] Assignees: Kokuyo Co., Ltd., Osaka; Takano Co., Ltd., Nagano, both of Japan

[21] Appl. No.: 553,274

[22] PCT Filed: May 31, 1995

[86] PCT No.: PCT/JP95/01075

§ 371 Date: Nov. 16, 1995

§ 102(e) Date: Nov. 16, 1995

[51] Int. Cl.[6] ..... A47C 4/42

[52] U.S. Cl. ..... 297/58; 297/440.24

[58] Field of Search ..... 297/35, 39, 41, 297/16.2, 55, 58, 255, 256, 440.24, 452.2; 403/79, 119, 150, 157

[56] References Cited

U.S. PATENT DOCUMENTS

| | | | |
|---|---|---|---|
| 2,757,715 | 8/1956 | Hendrickson | 297/58 |
| 2,757,717 | 8/1956 | Adler | 297/58 |
| 4,784,436 | 11/1988 | Sutherland | 297/440.24 |
| 4,881,776 | 11/1989 | Wang | 297/440.24 X |
| 5,154,382 | 10/1992 | Hoshino | 403/157 X |

FOREIGN PATENT DOCUMENTS

| | | | |
|---|---|---|---|
| 1238791 | 7/1960 | France | 297/58 |
| 50-156303 | 12/1975 | Japan . | |
| 1-31086 | 9/1989 | Japan . | |
| 4-22852 | 2/1992 | Japan . | |

*Primary Examiner*—Peter R. Brown

*Attorney, Agent, or Firm*—Banner & Witcoff, Ltd.

[57] ABSTRACT

The foldable chair in accordance with the invention comprises a front frame 1 having a backrest 12 and a front leg 11, a rear frame 2 projectably holding a slide link 22 which is pivotally mounted to the front frame 1 and provided with a rear leg 21 at its down end, and a seat 3 having its side pivotally supported by the rear frame 2 near its rear end and forward of the pivot position at the rear frame 2 pivotally supported by the front frame 1. The front frame 1 comprises a front leg pipe member 13 near whose upper end is pivotally mounted to the seat 3, a backrest pipe member 14 separately formed from the front leg pipe member 13 and a joint member 15 which connects the front leg pipe member 13 and the backrest pipe member 14 with each axis generally aligned, and the foldable chair has such an arrangement that in which the upper end of the slide link 22 is pivotally mounted to the joint member 15 that the axis of the rear leg 21 is generally aligned with that of the corresponding front leg 11 as viewed from the direction in which the foldable chair 100 is folded.

6 Claims, 7 Drawing Sheets

FOLDABLE CHAIR

FIELD OF ART

This invention relates to chairs, and particularly to foldable chairs that can be stacked one upon another.

BACKGROUND ART

Conventional foldable chairs of this type, for example, comprise a front-stand made of a metal pipe and formed into a generally U-shape continuously arranged with a backrest provided at the upper end thereof, a rear stand made of the same metal pipe as the front stand and formed into a generally U-shape, and a seat pivotally mounted to the front and rear stands, and have such a structure that as the front and rear stands are moved to approach each other, the seat is rotated toward the backrest to take an upright posture, thereby to fold the front and rear stands and the seat into a generally flat configuration.

In a foldable chair of the above structure, for example, the outer sides of the front and rear stands are connected through link members so that when the chair is folded, the front and rear stands overlap each other at both sides of the seat as Viewed from the front or rear side.

Since the link members are plate-shaped with a pivot portion provided at both ends, it tends to tilt toward the direction of its thickness because of the clearance of the pivot portion or deformation of itself. This makes it difficult to restrain the relative movement laterally to the rear stand and the front stand by such link members. As a result of this, if a big load acts on the chair wherein the upper end of the rear stand makes abutting engagement with the rear face of the front stand when in use, there is a problem that the link members are easily plastically deformed or broken because of the rear stand movement toward lateral direction.

There is another foldable chair in which slide links are slidably provided at the top end of each of the rear legs and have each of its top end pivotally mounted to the outer side of each of the front legs by a shaft.

In this chair, as the top ends of the slide links are connected to the outer sides of the front legs, the rear legs are placed on the outer sides of the front legs. As a result of this, the seat is supported away from the sides of the rear legs, thereby decreasing the strength to support the seat. In addition, as the rear legs are disposed outside the front legs, a plurality of such chairs arranged closely side by side require a broader space, thereby to decrease the efficiency to utilize space.

In order to solve these problems, a foldable chair has been proposed, in which a joint member is welded to the rear side of each front leg and the top end of a slide link is pivotally mounted to the joint member. With the slide link using the above joint member, as the joint member is fixed to the rear side of each front leg, the front and rear legs can be designed to overlap each other as viewed from the front or rear side when the chair is folded.

In the above arrangement, the welding of the joint members to the front legs must be conducted in a different working step outside the manufacturing line in which cutting and bending of pipe material is conducted. Therefore, the manufacturing line becomes complicated, and even though the line is automated, it is difficult to reduce the number of the manufacturing steps and consequently the manufacturing cost.

In addition, the conventional chairs are made of pipe members where a front leg and a back support rod of the backrest are integral therewith, thereby to require a large-scale facilities for molding pipe material. Further, for the foldable chairs of this type as there are a plurality of different shapes of the front leg and the backrest, a plurality of different facilities corresponding to the combination of these shapes are required. The facilities should be changed in whole for a change in specification of a front leg or a backrest alone, thereby to require time and labor for changing facilities.

DISCLOSURE OF THE INVENTION

This invention has been accomplished in view of the above problems. The object of the invention is to provide a foldable chair which is difficult to be broken by a load applied, which has a reduced lateral size to diminish space occupation when arranged side by side in use, and which can be tailored with ease to a change or addition in specification or the like.

To attain the above-mentioned object the invention has the following structure. The foldable chair in accordance with the invention comprises a front frame with a backrest provided at its top end and a front leg provided at its lower end, a rear frame at whose top end a slide link which is pivotally mounted to the front frame is projectably held and at whose lower end provided is a rear leg, and a seat having its both sides pivotally supported near its rear end by the rear frame and forward of the pivot position at the rear frame pivotally supported by the front frame. The foldable chair is characterized by that the front frame comprises a front leg pipe member near whose upper end is pivotally mounted to the seat, a backrest pipe member separately formed from the front leg pipe member, and a joint member which connects the front leg pipe member and the backrest pipe member with each axis generally aligned and that the chair has such an arrangement in which the upper end of the slide link is pivotally mounted to the joint member that the axis of each rear leg is generally aligned with that of the corresponding front leg as viewed from the direction in which the foldable chair is folded.

The joint member is preferably represented by that which comprises a body having an outer diameter generally the same as those of the front leg pipe member and the backrest pipe member, inserted portions projecting from each end of the body and each of which is to be fittingly inserted into the internal circumference of the abovementioned front leg pipe member and the backrest pipe member respectively, and a pivot portion projecting rearward from the back face of the body to be pivotally connected to the top end of the above-mentioned slide link integral therewith.

The joint member may be made of cast aluminum, or synthetic resin.

In accordance with the arrangement of the invention, the following functions and effects are achieved. The arrangement in which the front frame has the joint members to which the top end of the slide links of the rear frame is pivotally mounted makes it possible to prevent the rear leg from moving laterally to the front frame. As a result of this, it becomes easy to design the chair hard to be broken by the load applied. In addition, as the rear frame is pivotally mounted to the joint member constituting a part of the front frame, the axis of the rear leg is so arranged as to be generally aligned with the axis of the corresponding front leg as viewed from the direction in which the foldable chair is folded. This makes it possible to pivotally mount the rear frame to the seat at both sides near its rear end by means of a flat mount member so that the rear frame can pivot near at the lateral side of the seat when folded together with the front frame. In accordance with the arrangement of the invention, the distance between the rear frame and the seat is shortened, thereby to increase the strength of the points at which the seat is mounted to the rear frame. Further, the rear frame is disposed within the width of the front frame, the chair has a reduced lateral size. Therefore, a plurality of chairs can be arranged side by side in use with high density, with resulting in improvement of space efficiency.

Because of the arrangement in which the front leg and the back support rod of the backrest are separately formed of pipe material, no huge pipe molding facilities are required. Accordingly, a compact facility provided with a relatively small molding machine and conveyer will do for molding the front leg and the backrest separately. In addition, the combination of several different kinds of a front leg and backrest will make a front frame in great variety. This in turn makes it possible to be tailored with ease to a change in the shape of a front leg or in the structure of a backrest alone or the like.

In addition, the arrangement of the joint member comprising the body, the inserted portions and the pivot portion as mentioned above makes it possible to complete a front frame just by fixing the inserted portions to the front leg pipe member and the backrest pipe member by means of press fitting, or by inserting the inserted portion into the front leg pipe member and the backrest pipe member and then fixing them by rivet or bolt. Then the pivot portion of the joint member is brought into rigid attachment to the completed front frame. As a result of this, the front frame can be manufactured without adding a process of welding to the manufacturing line, thereby to simplify the manufacturing facilities compared to the facilities which require a process of welding to be added to a manufacturing line of pressing and bending.

BEST MODE OF EMBODYING THE INVENTION

An embodiment of the invention will now be described with reference to FIGS. 1 through 7.

Figure 2:
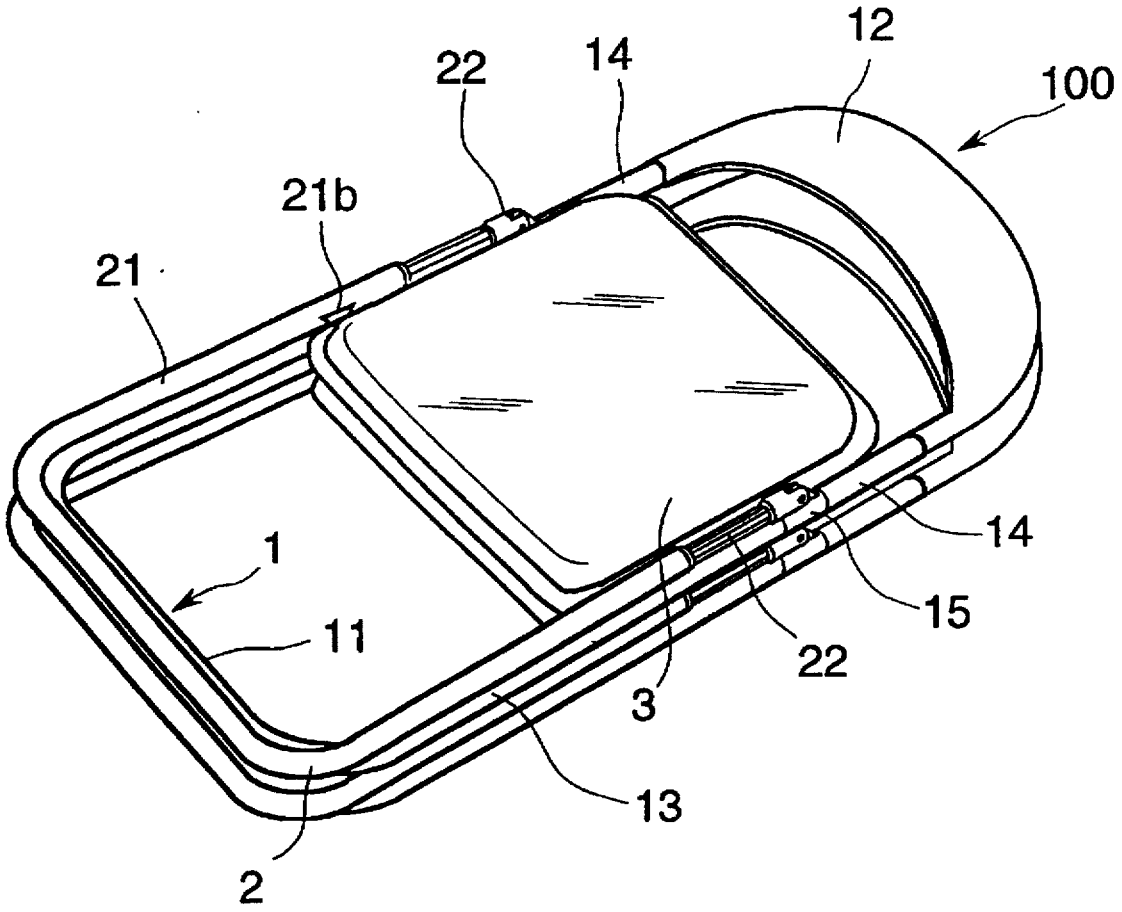
FIG. 2 is a perspective view showing the foldable chair of the preferred embodiment in a folded and stacked position.
Figure 3:
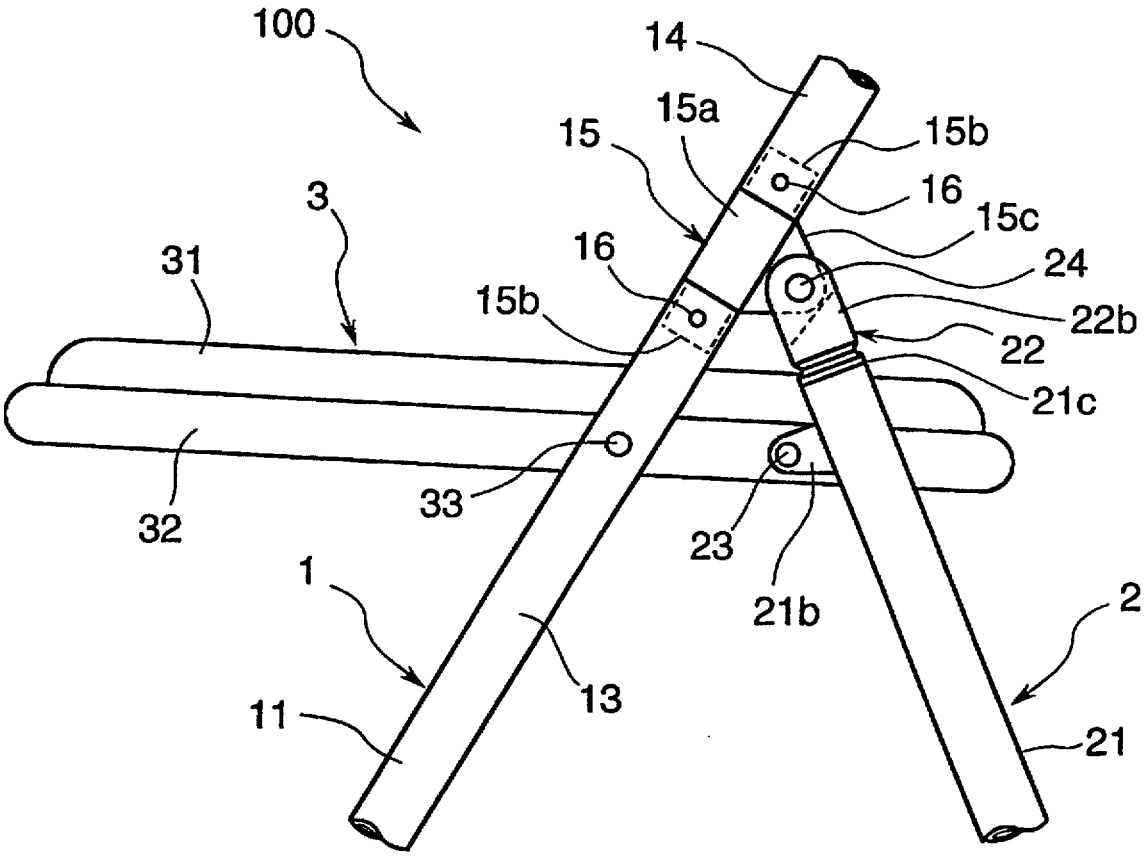
FIG. 3 is a side view showing the principal portion of the mechanism in accordance with the preferred embodiment.
Figure 4:
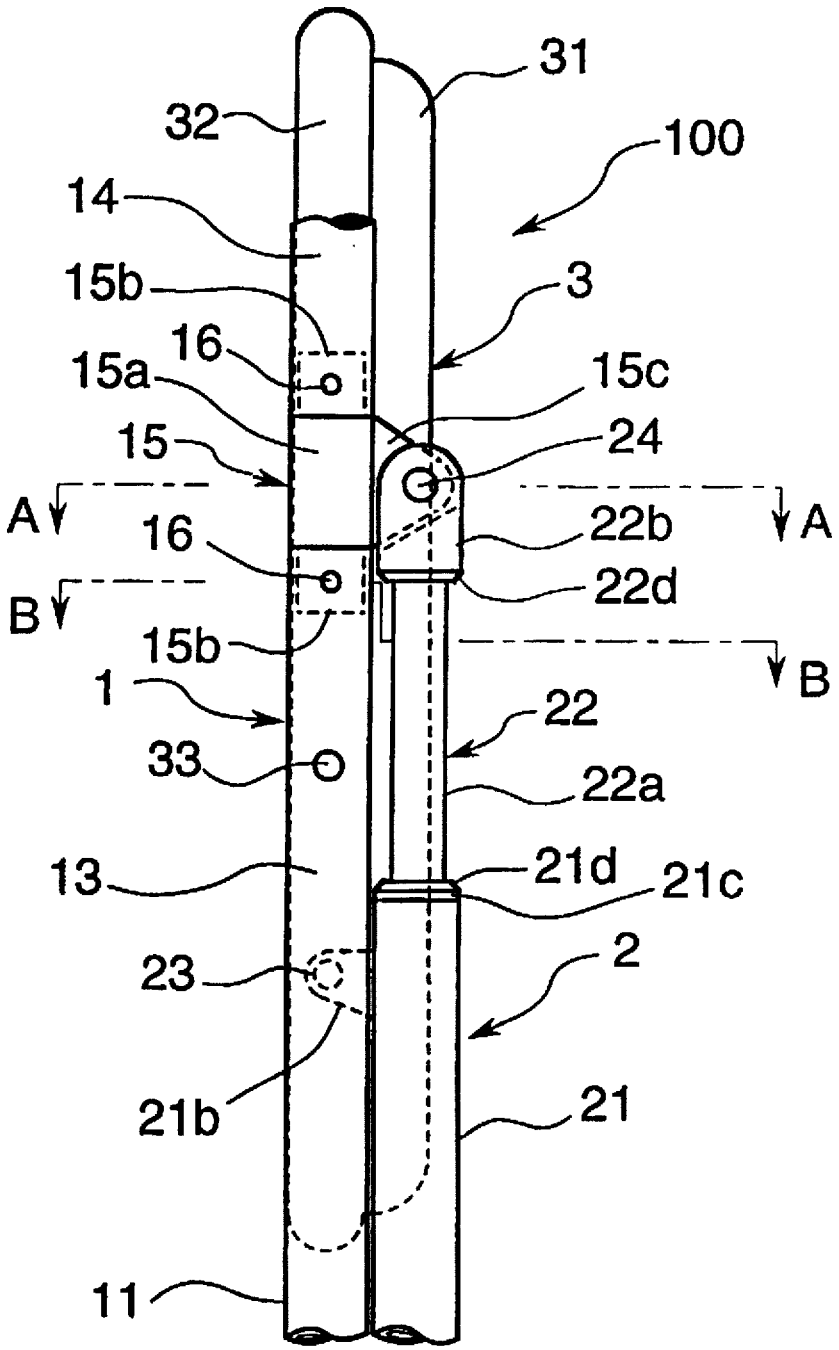
FIG. 4 is an explanatory view showing the function of the principal portion.

FIG. is a perspective rear view of a foldable chair 100 in accordance with a preferred embodiment of this invention shown in use. FIG. 2 is a perspective view of the foldable chairs of FIG. 1 folded and stacked in stock. FIG. 3 is a side view showing the foldable chair of FIG. 1 in use and the upper and lower ends of the front frame 1 and the lower end of the rear frame 2 are omitted to show in the drawing. FIG. 4 is a side view showing the foldable chair of FIG. 1 shown folded and similarly the upper and lower ends of the front frame 1 and the lower end of the rear frame 2 are omitted to show in the drawing.

Figure 1:
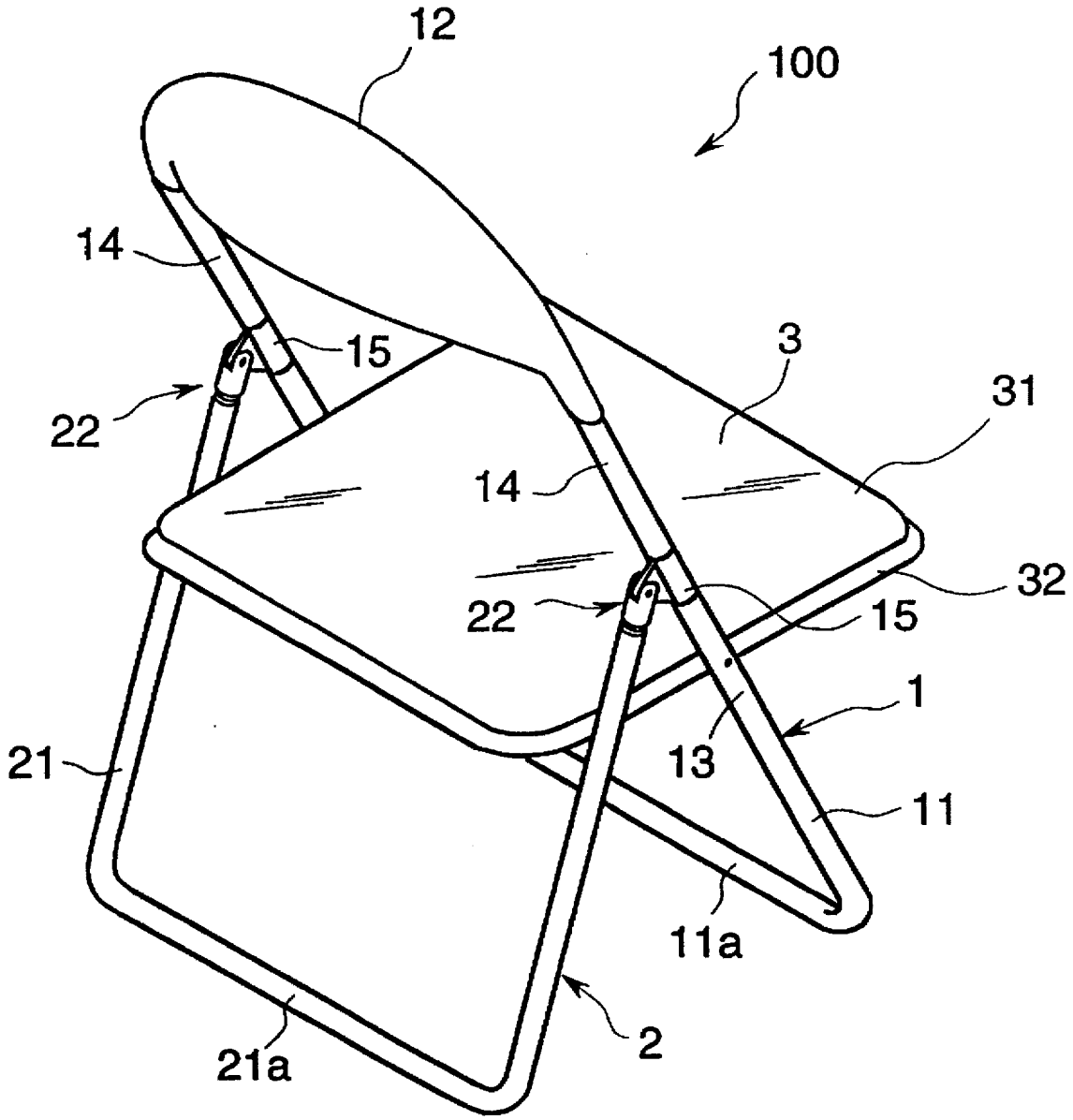
FIG. 1 is a perspective rear view showing a foldable chair in accordance with a preferred embodiment of this invention.

The foldable chair 100, as shown in FIGS. 1 and 3, comprises a front frame 1 having a front leg 11 and a backrest 12, a rear frame 2 having a rear leg 21 and a slide link 22, and a seat 3. The chair is, as shown in FIGS. 2 and 4, so arranged that it can be folded into a generally flat configuration with the front frame 1, the rear frame 2 and the seat 3 overlapped.

Figure 5:
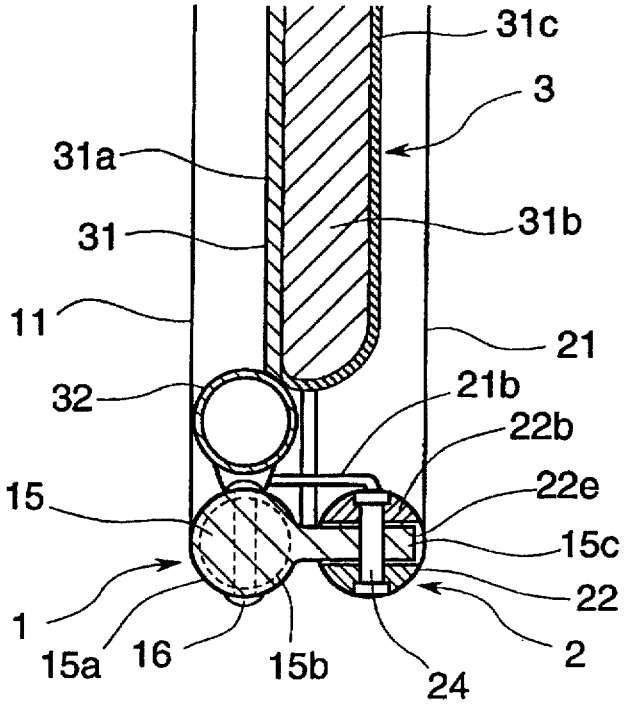
FIG. 5 is a sectional view taken along line A—A of FIG. 4.
Figure 7:
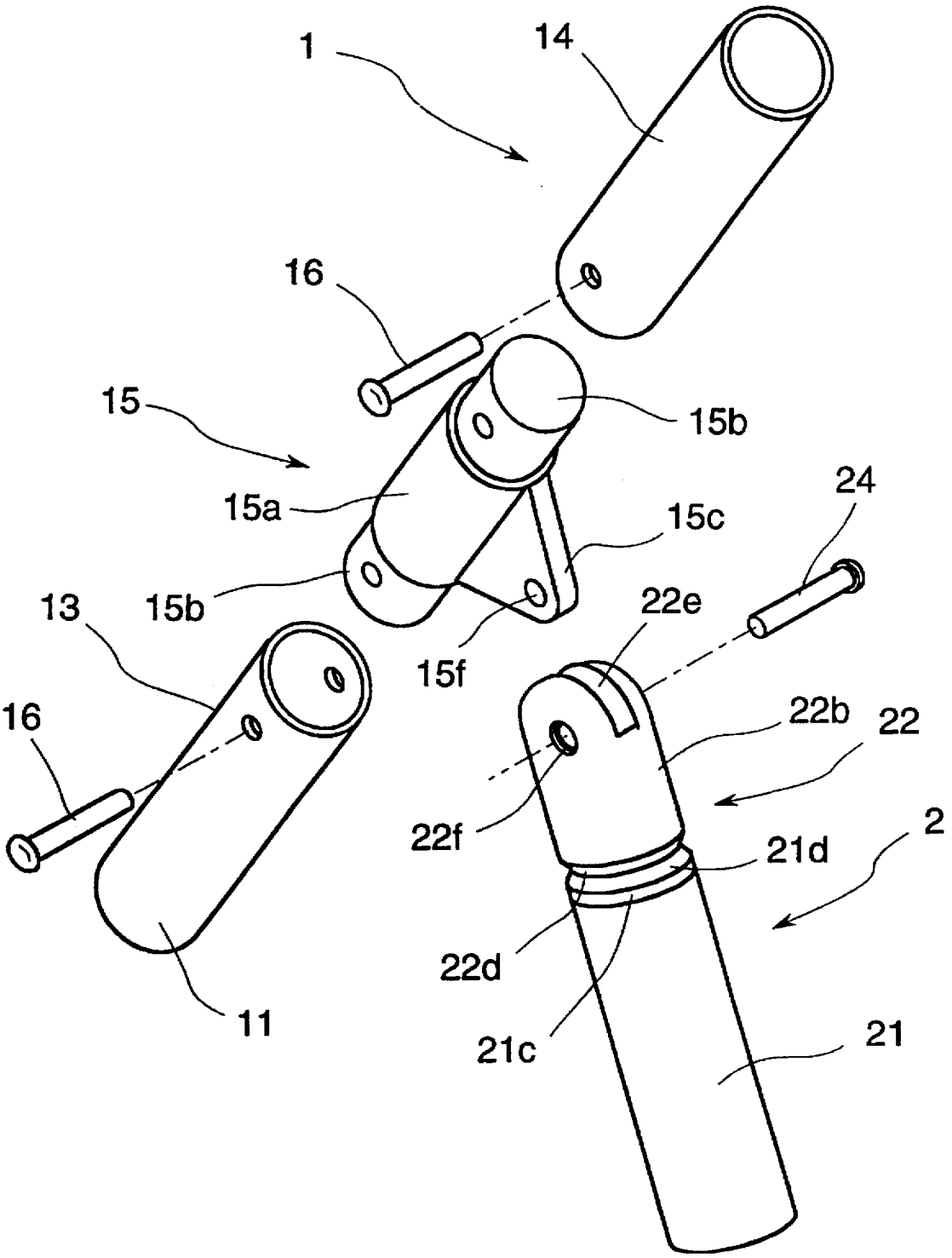
FIG. 7 is an enlarged exploded perspective view showing the principal portion of the embodiment.

The front frame 1 comprises a front leg pipe member 13 constituting a front leg 11, a backrest pipe member 14 separately formed from the front leg pipe member 13, and a joint member 15 connecting the front leg pipe member 13 and the backrest pipe member 14 with each of the axis generally aligned. The front leg pipe member 13 is made of steel pipe and processed to bend into a generally U-shape to form a lower crossbar 11*a* at the lower end thereof for being placed on the floor. The backrest pipe member 14 is made of steel pipe and supports a backrest 12 at its upper end. The joint member 15 is, for example, made of cast aluminum and comprises, as shown in FIGS. 5 and 7, a body 15*a* having an outer diameter generally the same as those of the front leg pipe member 13 and the backrest pipe member 14, inserted portions 15*b* projecting from both ends of the body 15*a* to be fittingly inserted into the internal circumference of the above-mentioned front leg pipe member 13 and the backrest pipe member 14, and a pivot portion 15*c* projecting rearward from the back face of the body 15 to be pivotally connected to the top end of the above-mentioned slide link 22 integral therewith. In this embodiment, the inserted portions 15*b* and each pipe member 13 and 14 are fixed by rivet 16 so as not to be pulled out. The front leg pipe member 13 pivotally supports the seat 3 at near the upper end thereof.

The seat 3 comprises a seat body 31 having a seat board 31*a*, a cushion material 31*b* on the seat board 31*a* and a covering material 31*c* over the cushion material 31*b*, and a seat frame 32 made of steel pipe which surrounds the seat body 31 and supports the seat board 31*a*. The arrangements of the seat 3 and the backrest 12 may be the same as well known in the art.

Figure 6:
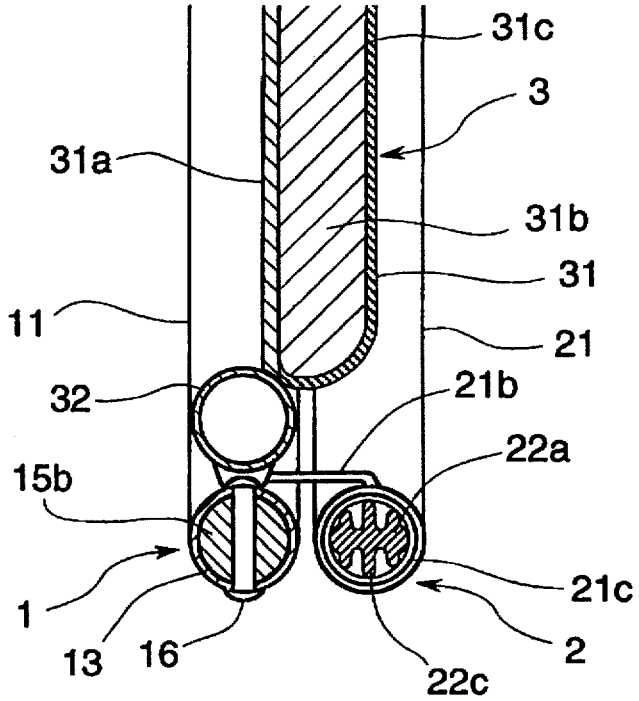
FIG. 6 is a sectional view taken along line B—B of FIG. 4.

The rear frame 2 comprises a rear leg 21 and a slide link 22 which is projectably held by the rear leg 21 at its upper end. The rear leg 21 is made of steel pipe and bent into a generally U-shape to form lower crossbars 21*a* at its lower end to be placed on the floor. The rear leg 21 pivotally joins a mount member 21*b* which is fixedly attached to near the upper end of the rear leg 21 and the seat frame 32 by means of a shaft 23, and at the upper end provided is a slide bearing 21*c* of synthetic resin into which the slide link 22 is projectably and fittingly inserted. The slide link 22 is of synthetic resin and comprises a shaft portion 22*a* to be inserted into the rear frame 2, and a pivot member 22*b* integrally formed at the top end of the shaft portion 22*a*. In order to diminish frictional resistance, the shaft portion 22*a* has such a configuration that a plurality of ribs 22*c* are integrally formed, as shown in the section of FIG. 6. The shaft portion 22*a* is, as shown in FIG. 3, inserted into the rear frame 2 when in use and, as shown in FIG. 4, extends from inside of the rear frame 2 as the rear frame 2 moves when the foldable chair 100 is folded. The slide bearing 21*c* prevents a cut end of the rear frame 2 from touching the pivot members 22b directly and prevents effectively pivot members 22b and the shaft portion 22a from being damaged by burr which is made inside the cut end of the rear frame 2 when the pipe member constituting the rear frame 2 is cut as well as supports the slide link 22 slidably and movably. The circumference 21d of the upper surface of each slide bearing 21c is chamfered considerably and the circumference 22d of the lower surface of the pivot member 22b facing the slide bearing 21c is also chamfered considerably (shown in FIG. 7). The pivot member 22b is cylinder in shape having an outer diameter generally the same as that of the front frame 1 and at the center of the tip thereof provided is a slit 22e into which the pivot portion 15c of the joint member 15 is to be inserted. Each of the pivot portion 15 of the joint member 15 and the pivot member 22b of the slide link 22 is provided with holes 15f and 22f corresponding each other into which a shaft 24 is inserted, thereby to pivotally connect the front frame 1 and the rear frame 2. The shaft 24 is fixed by being inserted into the holes 15f and 22f and then riveting the through end thereof.

In accordance with the arrangement, as the front frame 1 is provided with a joint member 15 to which the upper end of the slide link 22 is pivotally mounted, the upper end of the rear frame 2 is prevented from moving laterally to the front frame 1. As a result of this, it becomes easy to design a chair hard to be broken by the load applied. In addition, as the rear frame 2 is pivotally mounted to the joint member 15 constituting a part of the front frame 1, the axis of the rear leg 21 is so arranged as to be generally aligned with the axis of the corresponding front leg 11 as viewed from the direction in which the foldable chair is folded. This makes it possible to pivotally mount the rear frame 2 to the seat 3 at both sides near its rear end by means of a flat mount member 21b so that the rear frame can pivot at the lateral side of the seat 3 when folded together with the front frame 1. In accordance with the arrangement, the distance between each of the frames 1, 2 and the seat 3 is shortened, thereby to increase the strength of the points at which the seat 3 is mounted to the frames 1, 2. Further, as the rear frame 2 does not project from the lateral sides of the front frame 1, the chair 100 has a reduced lateral size. Therefore, a plurality of chairs 100 can be arranged side by side in use, with resulting in improved space efficiency.

Because of the arrangement in which the front leg 11 and the back support rod of the backrest 12 of pipe material are separately formed, no huge pipe molding facilities are required. Accordingly, a compact facility provided with a relatively small molding machine and conveyer will do for molding the front leg 11 and the backrest 12 separately. In addition, the combination of several different kinds of a front leg 11 and a backrest 12 will make a front frame 1 in great variety. This in turn makes it possible to be tailored with ease to a change in the shape of a front leg 11 or in the structure of a backrest 12 alone or the like.

In addition, the above-mentioned arrangement of the joint member 15 makes it possible to complete a front frame 1 just by inserting the inserted portions 15b into the front leg pipe member 13 and the backrest pipe member 14 and then fixing them by rivet. Then the pivot portion 15c of the joint member 15 is brought into rigid attachment to the completed front frame 1. As a result of this, the front frame 1 can be manufactured without adding a process of welding to the manufacturing line, thereby to simplify the manufacturing facilities compared to the facilities which require a process of welding to be added to a manufacturing line of pressing and bending.

The joint members are not limited to of cast aluminum but may be integrally molded of synthetic resin. The means to connect the joint member and the pipe member is not limited to rivet, but may be press fitting or bolt.

Figure 8:
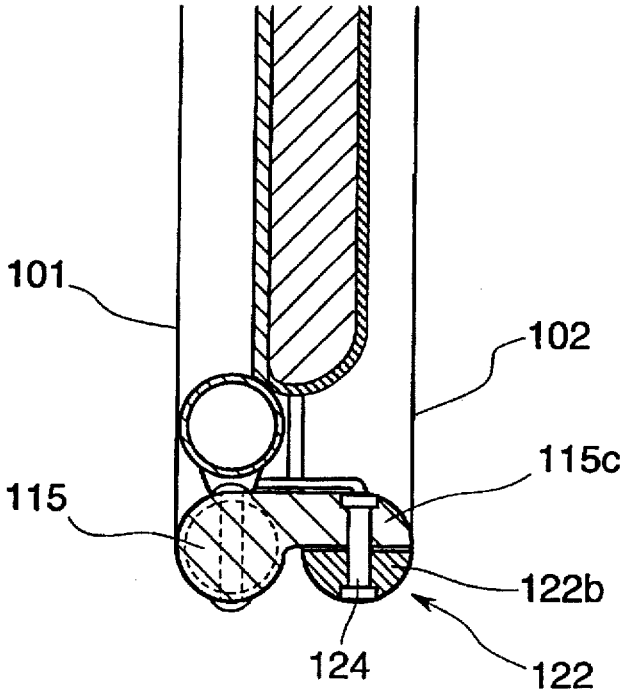
FIG. 8 is a sectional view similar to FIG. 5 and showing the another preferred embodiment of the invention.
Figure 9:
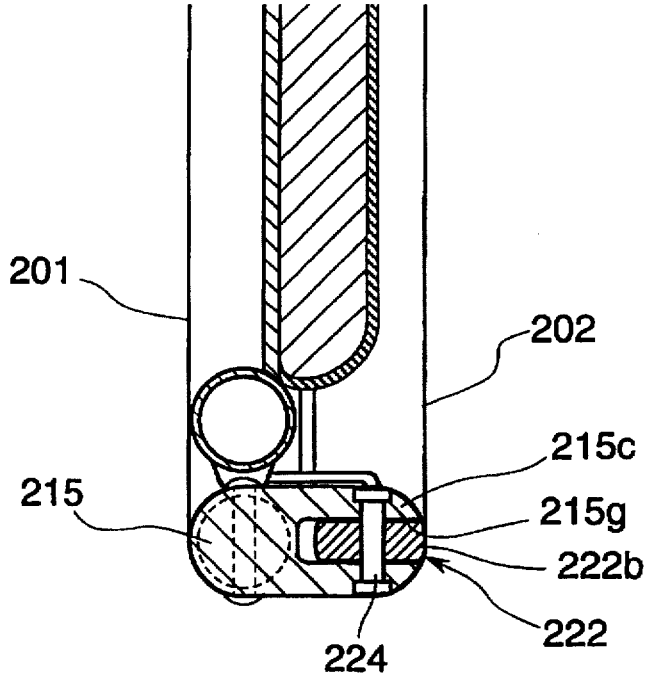
FIG. 9 is a sectional view similar to FIG. 5 and showing further preferred embodiment of the invention.

The shape of the pivot portion of the joint member and the pivot member of the slide link is not limited to those explained, but there may be, for example, as shown in FIG. 8 or 9. More specifically, the pivot portion 115c of the joint member 115 in the front frame 101 in FIG. 8 has a thickness corresponding to a radius of the front frame 101, and the pivot member 122b of the slide link 122 constituting the rear frame 102 has its tip formed semi cylinder by removing generally half of the cylinder. The tip of the pivot member 122b and the pivot portion 115c of the joint member 115 are pivotally joined by the shaft 124. The pivot portion 215c of the joint member 215 in the front frame 201 in FIG. 9 is bifurcated and at the mid-point thereof provided is a slit 215 into which a plate-shaped pivot member 222b of the slide link 222 is inserted. The pivot member 222b of the slide link 222 and the pivot portion 215c of the joint member 215 is pivotally joined by a shaft 224.

In the illustrated embodiment, the slide link is integrally molded of synthetic resin, but it may comprise a shaft portion and a pivot member as separate members. Namely, for example, a shaft may be of metal and a pivot member may be of synthetic resin, or both of them may be of metal. In the above embodiments, the shaft is an aggregation of the ribs, but may be a round pipe or a round rod. In this case, the outer surface of the shaft portion is preferably covered with resin having a small coefficient of friction so as to diminish the friction between the shaft portion and the slide bearing.

The front frame may not be limited to those illustrated, but there may be various modifications without departing from the spirit or essential characteristics thereof.

POSSIBILITY OF USE IN INDUSTRY

The foldable chairs in accordance with the invention are suitable for arrangement in many lines or rows on the floor in halls of every kind or gymnasiums, and easy to set for extra use when necessity requires to increase the number of seats in haste.

We claim:

1. A foldable chair comprising:

a front frame with a backrest provided at its top end and a front leg provided at its lower end;

a rear frame including a rear leg at a lower end thereof and a slide link which is pivotally mounted to the front frame and which telescopically projects outwardly from a top end of the rear frame; and a seat having its both sides pivotally supported near its rear end by said rear frame and forward of the pivot position at the rear frame pivotally supported by the front frame;

and is characterized by that said front frame comprises a from leg pipe member near whose upper end is pivotally mounted to the seat, a backrest pipe member separately formed from the front leg pipe member, and a joint member which connects the front leg pipe member and the backrest pipe member such that a longitudinal axis of said front leg pipe member is generally aligned with a longitudinal axis of said backrest pipe member, and that the foldable chair has such an arrangement in which the upper end of said slide link is pivotally mounted to the joint member such that the longitudinal axis of said rear leg is generally aligned with that of said corresponding front leg when the foldable chair is viewed from ks from or its rear.

2. The foldable chair as described in claim 1 wherein the joint member comprises a body having an outer diameter generally the same as those of said front leg pipe member and said backrest pipe member, inserted portions projecting from both ends of said body and each of which is to be fittingly inserted into the internal circumference of the front leg pipe member and the backrest pipe member respectively, and a pivot portion projecting rearward from the back face of the body to be pivotally connected to the top end of said slide link integral therewith.

3. The foldable chair as described in claim 2, wherein the joint member is of cast aluminum.

4. The foldable chair as described in claim 2, wherein the joint member is of synthetic resin.

5. The foldable chair as described in claim 1 wherein the joint member is of cast aluminum.

6. The foldable chair as described in claim 1 wherein the joint member is of synthetic resin.

* * * * *